United States Patent [19]

Winkler et al.

[11] 4,304,330

[45] Dec. 8, 1981

[54] CASE FOR WRITING UTENSILS

[75] Inventors: Gerhard Winkler, Nuremberg; Bernhard Endres, Winkelheid, both of Fed. Rep. of Germany

[73] Assignee: J. S. Staedtler, Nuremburg, Fed. Rep. of Germany

[21] Appl. No.: 35,816

[22] Filed: May 4, 1979

[30] Foreign Application Priority Data

May 5, 1978 [DE] Fed. Rep. of Germany ..... 2819618

[51] Int. Cl.[3] ..... A45C 11/36; B65D 1/36; B65D 41/18; B43K 31/00

[52] U.S. Cl. ..... 206/214; 206/45.19; 206/45.34; 206/224; 211/69.4; 211/69.5; 220/94 A; 220/306; 312/244; 312/285

[58] Field of Search ..... 220/306, 8, 281, 353, 220/23.4, 23.83, 23.86, 94 A; 206/371, 372, 373, 374, 275, 214, 224, 45.34, 45.19, 44.12, 44.13, 387; 211/69.1–69.5; D19/85; 312/208, 232, 244, 284, 285

[56] References Cited

U.S. PATENT DOCUMENTS

| | | | |
|---|---|---|---|
| D. 202,393 | 9/1965 | Wallerstein | D19/85 |
| 2,738,114 | 3/1956 | Kahlan et al. | 220/94 A |
| 2,876,924 | 3/1959 | Chrisman | 220/8 |
| 3,111,153 | 11/1963 | Sonka et al. | 220/306 X |
| 3,171,565 | 3/1965 | Nozette | 220/306 X |
| 3,253,871 | 5/1966 | Karper | 312/284 X |
| 3,356,462 | 12/1967 | Cooke et al. | 206/564 X |
| 3,424,341 | 1/1969 | Slapnik | 220/306 |
| 3,428,380 | 2/1969 | Danjczek | 206/371 |
| 3,601,277 | 8/1971 | Andrews et al. | 206/564 X |
| 3,635,350 | 1/1972 | Wolf | 220/23.4 X |
| 3,744,663 | 7/1973 | Moren | 206/45.34 |
| 3,800,974 | 4/1974 | Mogel et al. | 220/23.4 |
| 3,866,992 | 2/1975 | Katz | 211/69.5 |
| 3,877,575 | 4/1975 | Cracco et al. | 206/387 X |
| 3,877,766 | 4/1975 | Seebald | 312/244 X |
| 3,935,944 | 2/1976 | Wilson et al. | 220/20 X |
| 3,937,324 | 2/1976 | Whiteford | 206/372 X |
| 3,938,691 | 2/1976 | Dumas | 220/94 A |
| 4,101,027 | 7/1978 | Kohl et al. | 206/387 X |
| 4,103,773 | 8/1978 | Haber | 206/45.34 |
| 4,122,944 | 10/1978 | De Napoli | 206/349 |
| 4,128,285 | 12/1978 | Love et al. | 312/284 |

FOREIGN PATENT DOCUMENTS

| | | |
|---|---|---|
| 1904859 | 11/1964 | Fed. Rep. of Germany . |
| 7025078 | 6/1970 | Fed. Rep. of Germany . |
| 7215850 | 4/1972 | Fed. Rep. of Germany . |
| 7208162 | 6/1972 | Fed. Rep. of Germany . |
| 7315268 | 4/1973 | Fed. Rep. of Germany . |
| 7709688 | 1/1978 | Fed. Rep. of Germany . |

*Primary Examiner*—Allan N. Shoap
*Attorney, Agent, or Firm*—Toren, McGeady & Stanger

[57] ABSTRACT

A case for writing utensils and accessories consists of a base or receiving part into which the utensils and accessories fit, and a cover part which fits over the receiving part and projects upwardly from it. The upwardly projecting portion of the cover part forms an enclosed space into which the utensils and accessories can extend from the receiving part. The receiving part has protruberances extending outwardly from it which releasably interengage with openings in the cover part for locking the two parts together. A handle member is secured to the cover part so that the case can be easily carried.

9 Claims, 4 Drawing Figures

CASE FOR WRITING UTENSILS

SUMMARY OF THE INVENTION

The present invention is directed to a case for writing utensils and accessories and is made up of a cover part and a receiving part. The two parts are formed as separate members and can be completely removed one from the other. The receiving part has at least one surface which forms a base for the closed case. The case can be placed on a planar base, preferably with its major dimension extending vertically.

Writing utensil cases are used, in general, for storing and transporting fountain pens, drawing devices, felt pens, mechanical lead pencils and similar writing utensils and may also hold appropriate accessories for such utensils. Usually stands for writing utensils serve as a stationery receptacle with the utensils arranged in a predetermined and preferably vertical position, for example, a stand mounted on a desk or drawing table.

In German Utility Model No. 72 15 850 a storage device is disclosed particularly for pens, which illustrates a case of the general type to which the present invention is directed.

In this known case, however, there is the problem that no secure connection exists between the two parts. As a result, the parts can be separated from one another during transport and, further, the case has no carrying handle which could facilitate transport, particularly when entire sets of writing utensils are being carried.

In addition, for each individual writing utensil a separate receiving part with a corresponding separate cover part is required which would result in a very expensive case for a set containing a number of writing utensils and/or accessories.

In a known "box for ball point pens", German Utility Model No. 19 04 859, a "display stand" is shown consisting of a cover part and a receiving part formed as individual members which can be completely separated from one another. In this arrangement the cover part overlaps, to a limited extent, the receiving part. This box, however, is not easily transportable and, depending on its size, cannot be easily carried. Moreover, the cover part can be accidentally separated from the receiving part, particularly during transport, since there is not arrangement for securing the parts together.

In German Utility Model No. 72 08 162, a case for writing utensils is disclosed and is intended as a case for students and includes a shoulder carrying strap which could, to a limited extent, be considered as a gripping or handle element.

This particular embodiment does not have the two individual members in the form of a cover part and a receiving part which can be completely separated from one another and, in addition, it does not have a surface which can be used as a base surface for the case.

With such an arrangement it is not possible to effect positive positioning of the writing utensils in a predetermined orientation, that is, in a vertical position. Moreover, it is not possible to use the receiving portion as a separate stand for the writing utensils.

In German Utility Model No. 73 15 268, another box for holding pens is disclosed and it could possibly be characterized as a case. The box consists of a receiving part for the pens which could also be used as a stand, and a removable cover part. In this particular embodiment, however, it is difficult to grasp and transport the receiving part. Moreover, there is the danger of an accidental separation of the cover part from the receiving part, especially when the box is being carried.

In the "packaging for rod-like products" illustrated in German Utility Model No. 77 09 688 it is possible that the receiving part in a two-piece packaging design is suitable for use as a stand member for conventional writing utensils or similar rod-like utensils after the removal of the closing or locking lugs which engage the receiving part.

In this particular packaging arrangement, apart from the fact that there is no immediate connection of the two parts by locking elements, there is also no auxiliary member for gripping or carrying the packaging by hand. Moreover, the base surface for supporting the receiving part is exposed only after the removal of the outer packaging, accordingly, several manipulations are required before the receiving part can be used as a stand.

Therefore, the known cases or receptacles for writing utensils and the like are not equally suited for an advantageous and problem-free transport and for the aligned placement and insertion of the writing articles.

One feature of the present invention is the provision of an attractive case for writing utensils which is constructed so that it can be easily and conveniently transported. Furthermore, a part of the case can serve as a stand or holder for the writing utensils. The use of the stand is facilitated by the manner in which it can be particularly simply handled. Moreover, with such a case, it can be carried and arranged in the same position it is used as a stand or holder. Furthermore, the case of the present invention is very inexpensive and versatile and various design possibilities can be incorporated in the receiving part.

In accordance with the present invention, the cover part includes at least one loop-like or stirrup-like handle which extends from that portion of the cover part spaced upwardly from the receiving part. Preferably, the cover part is formed of a transparent, bending resistant, thermoplastics material. The receiving part holding the writing utensils is completely laterally enclosed by the cover part. Interengaging means on the two parts provide a secure and form-locking engagement between them, and also affords the complete separation of the cover part from the receiving part. Further, the cover part can be used for another receiving part filled with other writing utensils or accessories.

Due to the loop-like or stirrup-like gripping element or other equally advantageous holding means, such as gripping depressions, recesses or knobs, the holding and carrying of the case, which is also suitable as a stand for writing utensils, is facilitated. Further, the opening of the case is also facilitated, since the cover can be better grasped by means of the gripping element. In particular, it is easier to open the case if a bending resistant, thermoplastics material is used. Further, the use of a transparent thermoplastics material permits a viewing of the contents within the case and, accordingly, additional labelling indicating the contents is superfluous.

Since the cover part overlaps and laterally encloses the receiving part down to the plane of the base surface of the receiving part, an attractive case is afforded having the appearance of a self-enclosed unit. Opening of the case is facilitated, since the interengaging means which lock the parts together are located adjacent the base surface of the receiving part. As a result, the case can be easily grasped for unlocking its two separate parts. In addition, the stability of the receiving part, when used as a stand, can be increased by interconnecting the two parts after the cover part has been removed from the receiving part.

While it is possible to provide a cover part which does not completely laterally enclose the receiving part, in such an arrangement additional connecting means would be required for effecting the stability of the receiving part used as a stand.

In addition to the advantages mentioned above, the interengaging means securing the cover part and the receiving part together ensure the secure support of both parts to one another when the case is being carried or when the receiving part is used as a stand and is stabilized by the cover part and does not need any additional interconnecting means. As compared to pure adhesive connections, the fastening means of the present invention facilitate the opening of the case, since adhesive connections tend to jam unintentionally.

Resilient detents provide suitable interengaging means fitted into correspondingly shaped cutouts in the other part. To facilitate separation of the parts, the detents can be constructed as push or pull buttons with relatively large surfaces and may be arranged on either the wide or narrow sides of the case. Preferably, the detents are located on the receiving part. The cutouts which cooperate with the detents in providing the interlocking engagement may completely penetrate through the wall of the other part, preferably the cover part.

From experience it has been noted that it is advantageous if the detents are provided on the receiving part and the cutouts are formed in the cover part, preferably on a pair of oppositely arranged sides of each part.

Another feature of the invention is the possibility of using the interengaging means, possibly supplemented by additional connecting means, when the cover is removed and the case is opened. In other words, after the cover part is removed from the receiving part the two parts can be placed along side one another and interconnected to provide stability. The stability of the opened case can be significantly increased while the writing utensils in the receiving part are being used, when the position and design of the interengaging means are selected so that they can be effective when the two parts are arranged alongside each other on a base surface. Furthermore, this feature has the advantage that the cover part is positioned immediately adjacent the receiving part and, therefore, cannot be accidentally misplaced.

In addition to the use of the detents and cooperating cutouts the interengaging means can also be provided by employing the press button principle where, with the appropriate placement of locking pins, for example, along the wider side of the case, the interengaging means used in the closed condition of the case can also serve for connecting the parts together when the case is opened and the parts are positioned alongside one another. In such an arrangement, it is advantageous to use clamping slots instead of bores or openings which facilitate the interengagement of the two parts, when they are positioned parallel to one another. It has been found that the case embodying the present invention is suitable for any type or assortment of writing utensils, since the receiving part with appropriate dimensioning and design of its receptacles can at the same time hold any accessories needed with the writing utensils. The case can be tailored for any intended use. Accordingly, with the case embodying the present invention, an easily transportable member is provided which securely packages the writing utensils and other accessories and also affords a stand for the utensils and accessories when the cover part is removed so that the receiving part can be placed in a working position.

Furthermore, it is possible to form the receiving part with receptacles arranged to receive any desired writing utensil or accessory, while the arrangement of the cover part remains unchanged. Therefore, it is possible to produce cases which are economical for various fields of use and which always utilize the same cover part.

To fasten the receiving part to a desk or similar base structure, bores or recesses can be provided into which a clip or clamp can be engaged to effect the fastening action. For instance, the cover part can be recessed in the region of its fastening elements to ensure its attachment to the receiving part even when the interengagement means are operative or to facilitate the easy removal of the receiving part.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
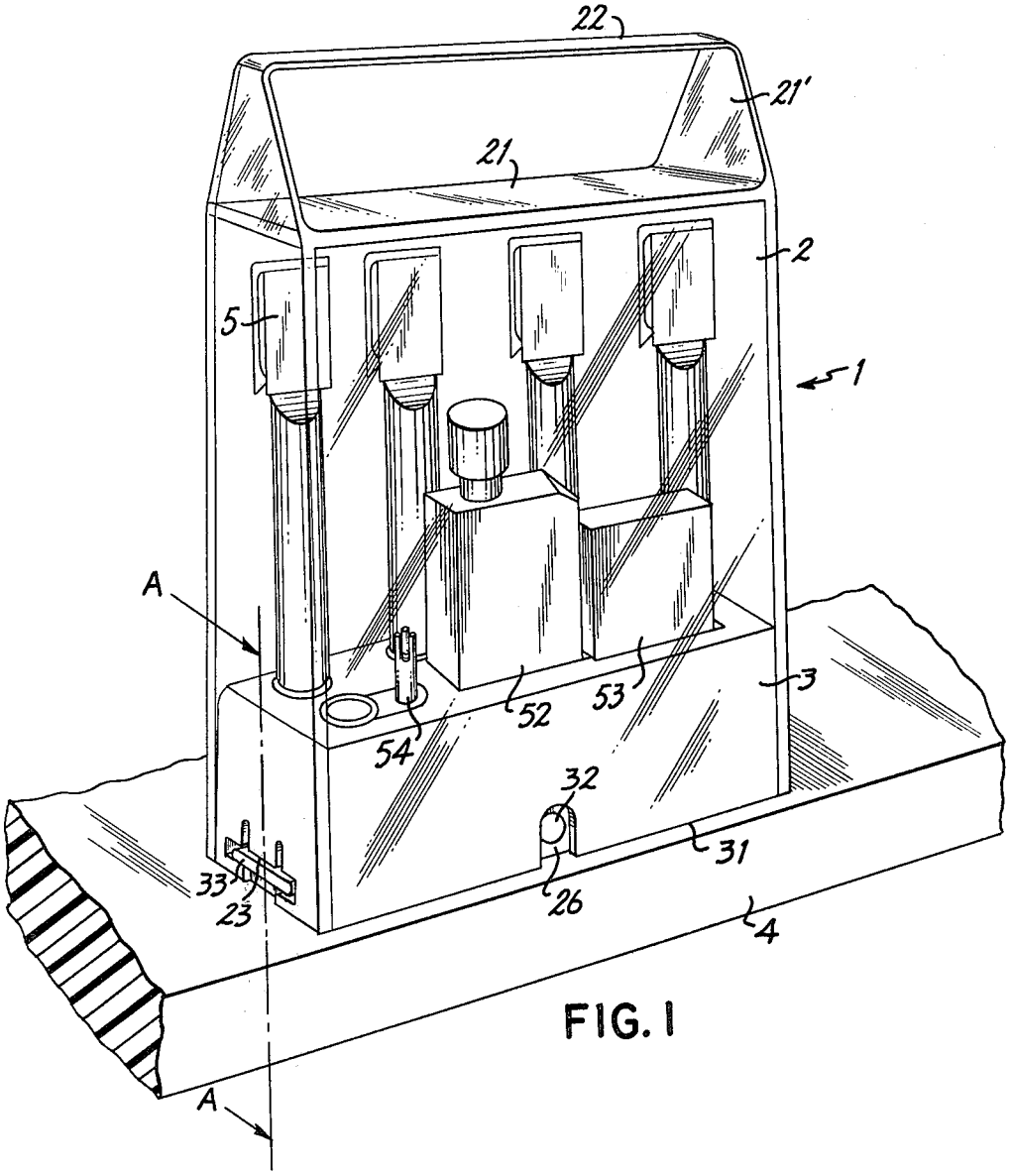
FIG. 1 is a perspective view of a case embodying the present invention including a transparent cover part and with the cover and receiving parts arranged in the closed condition.

In FIG. 1 an embodiment is shown of a case 1 exemplifying the present invention with the case formed of a receiving part 3 positioned on a base 4 with a cover part 2 fitted downwardly over the receiving part so that its lower open side also rests on the base 4. As can be seen in this illustration, the cover part is transparent. Receiving part 3 has a bottom wall in contact with the base 4 and a top wall spaced upwardly from it and containing a number of insets or recesses in which writing utensils 5, such as ink drawing utensils, fountain pens, ball point pens or the like are positioned. The recesses are arranged so that the utensils 5 extend substantially vertically upwardly within the hollow space above the receiving part formed by the enclosing cover part. In addition to the writing utensils 5, additional accessories are positioned within recesses in the top wall of the receiving part, for instance, a drawing ink bottle 52, an eraser 53 and a holder for a compass 54. Due to the transparency of the cover part, the writing utensils and accessories inserted into the receiving part can be easily viewed. Similarly, the smooth upstanding sides of the receiving part extending between its bottom and top walls can be used as labelling surfaces for company imprints, assortment descriptions, advertising imprints, complete tables of contents or the like. The cover part 2 has a closed lateral wall part extending upwardly from the open lower end to a top wall 21 forming a closure for the space within the cover part extending upwardly from the receiving part. The closed lateral wall part is rectangular in cross section viewed in a plane extending parallel with the base 4. Extending upwardly from the top wall 21 is a handle or gripping element 22 having a stirrup-shaped configuration with two legs or extensions 21' extending upwardly from the opposite narrow ends of the top wall 21 to a transversely extending web which interconnects the extensions 21'. As viewed in FIG. 1, the gripping element 22 is formed integrally with the cover part 2.

In the lower region of the narrow sides of the closed lateral wall part of the cover part 2 and of the receiving part 3 interconnecting means are provided in the form of a detent 33 and a cutout 23. A detail of the detent 33 and the cutout 23 is provided in FIG. 4. Slots extend through the receiving part 3 upwardly from the upper side of the cutout, note FIG. 1.

Figure 2:
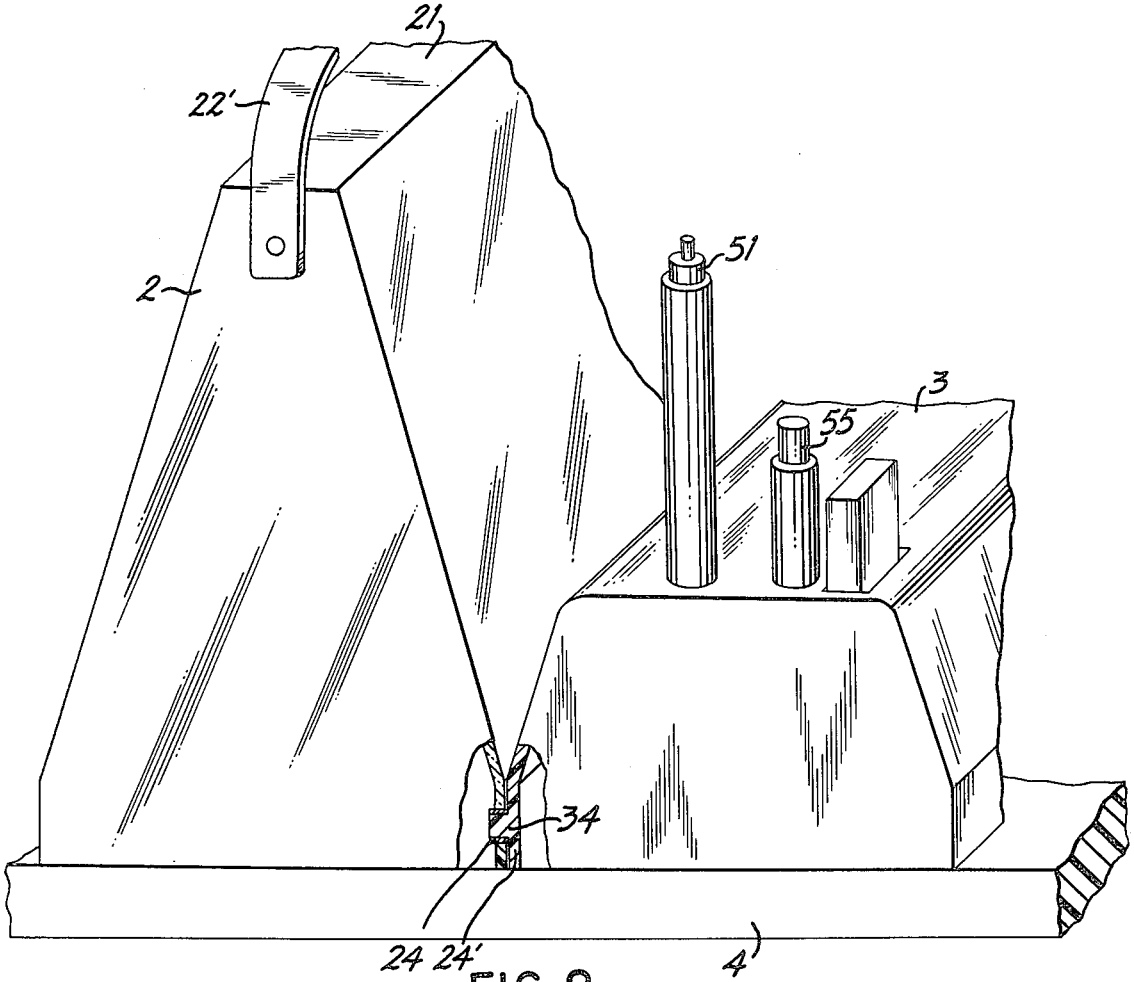
FIG. 2 is a perspective partial view, partly in section, of another embodiment of the present invention with the cover part removed from the receiving part and with the parts juxtaposed and connected to one another.

In FIG. 2 another embodiment of a case incorporating the present invention is disclosed, however, compared to FIG. 1 the shape of the cover part 2 and the receiving part 3 is more trapezoidal with one pair of sides converging inwardly in the upward direction so that a more stable design is provided. To ensure that the two parts of the case in the open condition can adequately contact one another, a narrow band along the wide side of each part is provided in parallel relation with the other, note the sectioned portion of FIG. 2. As can be seen in the sectioned portion, even in the opened state, the cover part and the receiving part are interengaged by means of locking pins 34 extending outwardly from the receiving part 3 into combined locking bores 24 and clamping slots 24'. At the upper end of the cover part 2 formed by the top wall 21, another gripping element 22' is shown formed of a carrying loop made of a soft fabric-like material to provide similar cases with this feature of the invention. In place of the carrying loop shown in FIG. 2, a gripping element such as shown in FIG. 1 could be used formed by a strut or stirrup-like member joined to the top wall of the cover part 2. In FIG. 2, the receiving part 3 contains writing utensils illustrated as a felt pen 51 and a refill cartridge 55.

Figure 3:
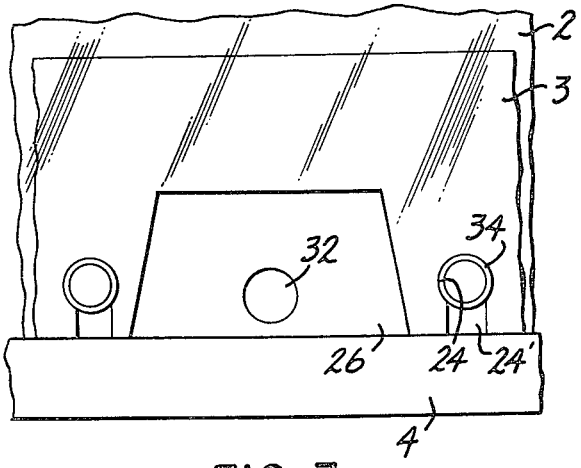
FIG. 3 is a side view illustrating a detail of the elements which interconnect the case parts.

In FIG. 3 a side view of a case 1 in the closed condition is illustrated with the cover part 2 fitted downwardly over the receiving part 3. Two laterally spaced locking pins 34 are provided on the receiving part 3 and extend outwardly through locking bores 24 formed in the cover part. The dimensions of the locking pins 34 and the locking bores 24 are arranged to provide the desired locking action. A clamping slot 24' extends downwardly from each of the locking bores 24 so that the cover part can be inserted downwardly over the receiving part with the slots 24' aligned with the locking pins 34. The locking pins 34 and the combined bores 24 and slots 24' are provided on opposite sides of the receiving part 3 and cover part 2. Positioned between the locking pins 34 on the receiving part 3 is a fastening bore 32 for receiving a clamp for securing the case 1 to the base 4, for example, a desk. In this arrangement, the cover part 2 has an additional cutout 26 located around the bore 32 in the form of a trapezoidally shaped slot open toward the open lower end of the cover part. The cutout 26 can be made significantly larger than the fastening bore 32 to afford better support while the case is being opened or to provide an additional gripping surface on the receiving part around the bore 32 so that the receiving part can be grasped more easily and the cover part can be removed from it without difficulty. When the cover part is pulled upwardly off the receiving part, the locking pins 34 slide through the clamping slots 24' assuring the proper removal of the cover part.

Figure 4:
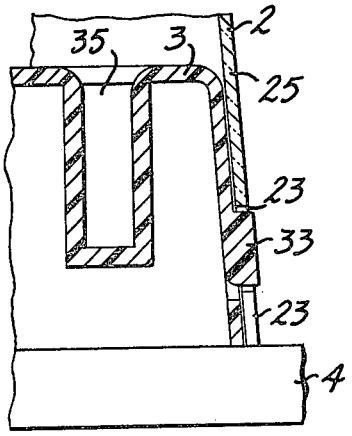
FIG. 4 is a partial sectional view of the case shown in FIG. 1 taken along the line A—A.

FIG. 4 shows, in an enlarged section, a detail of the connecting assembly exhibited in FIG. 1. In FIG. 4, the radially resilient detent 33 formed on and extending outwardly from the receiving part 3 extends through a cutout 23 in the cover part 2, it will be noted that the cutout 23 extends completely through the wall 25. In addition, a recess or receptacle 35 is formed in the receiving part 3 for a writing utensil or an accessory. In this embodiment, the receiving part is a hollow shaped member providing the various recesses or receptacles for the writing utensils or accessories.

In addition to the embodiments illustrated, it is possible to utilize the concept of the present invention in a cover part which is not formed of a bending-resistant, thermoplastics material, rather a soft material such as a padded fabric or artificial leather could be used. In such an embodiment, it would be merely necessary to reinforce the connecting means.

It is also possible to incorporate recesses or receptacles in the receiving part exclusively for compasses or other auxiliary implements for drawing and writing or as used in connection with other suitable writing utensils so that a writing utensil box is provided complete with all the appropriate accessories. It is particularly advantageous, depending on the manner of use, to maintain a store of different receiving parts which can be inserted into the same cover part with each receiving part designed and shaped to receive different writing utensils or accessories.

While straight sided receiving parts and cover parts have been illustrated, it will be appreciated that various shapes can be used as long as the interengaging features are provided for locking the parts together whether the case is in the open or closed condition.

While specific embodiments of the invention have been shown and described in detail to illustrate the application of the inventive principles, it will be understood that the invention may be embodied otherwise without departing from such principles.

What is claimed is:

1. Case for carrying writing utensils, accessories and the like and also for use as a desk-top stand when the utensils and accessories are being used, comprising:

A. a receiving part for holding the utensils and accessories in a generally upright position and comprising:

1. a horizontal peripheral bottom edge serving as the base for said receiving part when said receiving part is placed on a horizontal support surface,
2. a peripheral side wall extending upwardly from said bottom edge,
3. a top wall extending transversely across the upper end of said peripheral side wall and forming a closure thereof,
4. said top wall having downwardly extending recesses therein open in the plane of said top wall and closed at the lower ends thereof for supporting the utensils and accessories in the upright position, 5. said bottom edge, peripheral side wall, and top wall each having a rectangular shape in horizontal plan;

B. a cover part for said receiving part for the protected, enclosed storage and transportation of the writing utensils and accessories, said cover part comprising:

1. an upright tubular wall having an upper end and a lower end with the lower end thereof being open, and said tubular wall is rectangularly shaped in section transversely of the direction between the upper and lower ends and having a longer dimension and a shorter dimension,
2. a top wall extending transversely across and forming a closure for the upper end of said tubular wall,
3. said tubular wall has a height between said upper and lower ends thereof greater than the height of said receiving part between said bottom edge and said top wall thereof,
4. said tubular wall of said cover part is telescopically positionable downwardly in a sliding fit over said receiving part so that with the lower end of said tubular wall in the same plane as said bottom edge of said receiving part said top wall of said cover part is spaced upwardly from said top wall of said receiving part so that said tubular wall and said top wall of said cover part located upwardly from said top wall of said receiving part in the closed condition of the case enclose the space containing the utensils and accessories extending upwardly from said top wall of said receiving part, and
5. said cover part is totally transparent;

C. a handle for ease in carrying and opening the case is:

1. secured to the upper end portion of said tubular wall,
2. extends in the upward direction from said top wall of said cover part, and
3. extends in the direction of the longer dimension of said tubular wall;

D. locking means for securely locking said cover part to said receiving part in the telescoped position and said locking means being easily openable for removing said cover part from said receiving part, comprising:

1. detents in one of said receiving part and cover part and cutouts in the other one of said receiving part and cover part for lockingly receiving said detents,
2. at least two symmetrically positioned and slightly resilient said detents arranged in said receiving part,
3. at least two said cutouts are provided in said cover part corresponding in location to said detents,
4. said cutouts extend completely through said tubular wall of said cover part,
5. said detents being automatically yieldable in a resilient manner when said cover part is placed telescopically over said receiving part for automatically locking said cover part and receiving part together, and
6. said detents being manually displaceable through said cutouts for releasing the locking engagement of said cover part to said receiving part,
7. said cutouts being in the form of enlongated slots extending upwardly from the opened lower end of said tubular wall, said cutouts further having means to retain said detents when said case is carried by said handle.

2. Case, as set forth in claim 1, wherein said cover part is formed of a bending-resistant, thermoplastics material.

3. Case, as set forth in claim 1, wherein said top wall of said cover part has a pair of opposite ends extending transversely of the longer direction of said tubular wall, said handle comprises a stirrup shaped member having a pair of legs and a web extending between and interconnecting said legs, each of said legs attached to one of said opposite ends of and extending upwardly from said top wall of said cover part.

4. Case, as set forth in claim 3, wherein said stirrup shaped member is formed integrally with said cover part.

5. Case, as set forth in claim 1, wherein each said detent comprises a button-like locking pin on said receiving part, and means in said receiving part for receiving a clamp for securing said receiving part to a horizontal support surface.

6. Case, as set forth in claim 1, wherein said bottom edge and said top wall of said receiving part each have the same rectangular shape as viewed in the plane containing said bottom edge, and said peripheral side wall in a plane parallel to said bottom edge has the same rectangular shape as said bottom edge and top wall.

7. Case, as set forth in claim 1, wherein said top wall of said receiving part has a similar rectangular shape of smaller area compared to said bottom edge of said receiving part, said peripheral side wall having at least two opposed first walls spaced apart and forming opposite sides of said receiving part with said opposed first walls diverging in the downward direction from said top wall toward said bottom edge with the lower ends of said opposed first walls spaced upwardly from said bottom edge.

8. Case, as set forth in claim 7, wherein said peripheral side wall has two pair of opposed second walls with said second walls in each said pair disposed in parallel relation and extending downwardly from the plane containing the lower ends of said opposed first walls to said bottom edge.

9. Case, as set forth in claim 8, wherein said tubular wall of said cover part has at least one pair of opposed walls converging inwardly toward one another in the upward direction toward said top wall thereof and said inwardly converging walls located in part in said tubular wall coextensive with said side wall in the closed condition of the case with the remainder of said inwardly converging walls located above said top wall of said receiving part.

* * * * *